US009309028B2

(12) United States Patent
Kealy et al.

(10) Patent No.: US 9,309,028 B2
(45) Date of Patent: Apr. 12, 2016

(54) DEVICE FOR EXPRESSING SUBSTANCES FROM A DEFORMABLE TUBE

(75) Inventors: Patrick Kealy, Kilkenny (IE); Liam P. O'Dwyer, Celbridge (IE)

(73) Assignee: Henkel IP & Holding GmbH, Duesseldorf (DE)

( * ) Notice: Subject to any disclaimer, the term of this patent is extended or adjusted under 35 U.S.C. 154(b) by 0 days.

(21) Appl. No.: 13/447,365

(22) Filed: Apr. 16, 2012

(65) Prior Publication Data

US 2012/0248145 A1 Oct. 4, 2012

(30) Foreign Application Priority Data

Oct. 23, 2009 (GB) ..... 0918631.3

(51) Int. Cl.
*B65D 35/28* (2006.01)
*B65D 35/24* (2006.01)

(52) U.S. Cl.
CPC ..... *B65D 35/28* (2013.01)

(58) Field of Classification Search
CPC ..... B65D 35/28; B65D 35/56
USPC ..... 222/103, 105, 183, 207, 567, 568, 222/321.6, 321.8, 386
See application file for complete search history.

(56) References Cited

U.S. PATENT DOCUMENTS

| | | | | |
|---|---|---|---|---|
| 1,876,489 | A | 9/1932 | Collins | |
| 1,949,607 | A * | 3/1934 | Harrold | 248/109 |
| 2,210,226 | A * | 8/1940 | Weisberger | 222/103 |
| 2,259,992 | A * | 10/1941 | Binon | 222/179.5 |
| 2,544,751 | A * | 3/1951 | Elterman et al. | 248/109 |
| 2,568,286 | A | 9/1951 | Littlefield | |
| 2,656,069 | A * | 10/1953 | Fogarty et al. | 222/103 |
| 3,211,341 | A * | 10/1965 | Bailey | 222/103 |
| 3,405,843 | A | 10/1968 | Watson, Jr. | |
| 4,213,543 | A | 7/1980 | Thiem | |
| 4,313,686 | A * | 2/1982 | Proffer | 401/127 |
| 4,723,687 | A | 2/1988 | Kutterer | |
| 5,323,932 | A * | 6/1994 | Bauman | 222/96 |
| 5,501,369 | A * | 3/1996 | Tal | 222/103 |
| 5,578,020 | A * | 11/1996 | Mosley | 604/295 |
| 5,799,910 | A * | 9/1998 | Dexter | 248/109 |
| 6,315,165 | B1 * | 11/2001 | Regan | 222/103 |
| 6,419,124 | B1 * | 7/2002 | Hennemann et al. | 222/321.6 |
| 6,669,055 | B1 * | 12/2003 | Coleman et al. | 222/103 |

(Continued)

FOREIGN PATENT DOCUMENTS

| | | | |
|---|---|---|---|
| BE | 418523 | A | 12/1936 |
| CN | 2132595 | Y | 5/1993 |

(Continued)

*Primary Examiner* — Paul R Durand
*Assistant Examiner* — Charles P Cheyney
(74) *Attorney, Agent, or Firm* — James E. Piotrowski

(57) ABSTRACT

A device for expressing a substance from a deformable tube has a casing with a base end, a top portion opposite the base end and side wall portions intermediate the base end and the top portion. A squeezer is received in the casing. The squeezer has two opposing jaws for gripping and expressing a substance from the tube. The casing has an aperture in the top portion through which a discharge outlet of the tube is extendable. The casing also has apertures in opposing parts of the side wall portions through which the jaws can be actuated. The squeezer has a manual lever element on at least one jaw, which is attached to the jaw by a fulcrum so that manual pressure applied to the lever element about the fulcrum causes flexing of the jaw and squeezing of the tube.

17 Claims, 7 Drawing Sheets

(56) References Cited

U.S. PATENT DOCUMENTS

| | | | | |
|---|---|---|---|---|
| 7,077,292 | B2 * | 7/2006 | Turano | 222/103 |
| 2007/0017930 | A1 | 1/2007 | Gorrie | |
| 2007/0218229 | A1 * | 9/2007 | Nagahama et al. | 428/35.7 |
| 2009/0137972 | A1 * | 5/2009 | Katayama | 604/295 |
| 2009/0224008 | A1 * | 9/2009 | Rushe et al. | 222/562 |
| 2010/0163581 | A1 * | 7/2010 | Vandromme | 222/214 |
| 2011/0106024 | A1 * | 5/2011 | Katayama | 604/294 |
| 2012/0191067 | A1 * | 7/2012 | Chia et al. | 604/506 |

FOREIGN PATENT DOCUMENTS

| | | | | |
|---|---|---|---|---|
| EP | 0521200 | B1 | 4/1996 | |
| FR | 1170939 | A | 1/1959 | |
| FR | 1210659 | A | 3/1960 | |
| GB | 451933 | A | 8/1936 | |
| GB | 2206567 | A | 1/1991 | |
| JP | 2003226374 | A | 8/2003 | |
| WO | 0000405 | A2 | 1/2000 | |
| WO | WO 2010007961 | A1 * | 1/2010 | B65D 83/76 |

* cited by examiner

DEVICE FOR EXPRESSING SUBSTANCES FROM A DEFORMABLE TUBE

FIELD OF THE INVENTION

The present invention relates to an improved device for expressing a substance from a deformable tube. The tubes in question are yieldable tubes, which are usually comprised of metal or plastics. The metal or plastics tubes are squeezable. Squeezing of the tube by hand expresses the substance contained in the tube through a delivery nozzle. This can be a tricky and messy operation especially when the tube is not completely full.

The amount of substance being expressed is not easy to regulate by pressing with fingers, and it is difficult to simultaneously regulate the amount dispensed and its application to a substrate. Accordingly dispensing devices have been used to overcome these problems. Examples of deformable tubes include those containing pasty or thixotropic substances such as adhesive.

BRIEF DISCUSSION OF RELATED ART

Many dispensing devices are known for example from UK patent application No. 2,206,567 A and UK patent No. 451, 933, French patent application Nos. 1,170,939, 1,210,659 and 1,170,939, European patent No. 0521200, U.S. Pat. Nos. 1,876,489, 4,213,543, 3,405,843, 2,568,286, 334,638 and 4,723,687, Belgian patent application No. 418523. Such devices provide various methods of expressing a substance from a tube.

A further device of the type described above is disclosed in International (PCT) patent publication No. WO 00/00405, which is assigned to the assignee of the present invention and which is incorporated in its entirety by reference herein. This PCT publication describes a device having a casing having a base end, a top portion opposite the base end and side wall portions intermediate the base end and the top portion, a squeezer insertable in the casing, the squeezer comprising two opposing jaws for gripping and expressing a substance from the tube, the casing having an aperture in the top portion through which a discharge outlet of the tube is extendable and further having apertures in opposing parts of the side wall portions through which the jaws are actuatable.

The device disclosed in WO 00/00405 has a squeezer which expresses a substance from the tube when pressure is suitably applied to the jaws. Notwithstanding the usefulness of such a device it is desirable to provide an alternative device for expressing a substance from a deformable tube.

In particular it is desirable to provide a device for applying force to the tube which is capable of expressing the contained substance in a more controlled manner. Furthermore it is desired to provide a construction of device which is less expensive to manufacture than that disclosed in WO 00/00405.

A variety of nozzles and caps have been utilised in devices such as the present invention to facilitate accurate and easy expression of substances from tubes. An example of such nozzle and cap arrangement is disclosed in PCT Application No. PCT/EP2009/052472, assigned to the assignees of the present invention, and the entire contents of which is expressly incorporated herein by reference.

SUMMARY OF THE INVENTION

The present invention provides for a device for expressing a substance from a deformable tube, the device comprising: a casing having a base end, a top portion opposite the base end and side wall portions intermediate the base end and the top portion, a squeezer insertable in the casing; the squeezer comprising two opposing jaws for gripping and expressing a substance from the tube, the casing having an aperture in the top portion through which a discharge outlet of the tube is extendable and further having apertures in opposing parts of the side wall portions through which the jaws are actuatable, wherein the squeezer further comprises a manual lever element on at least one jaw, the lever element being attached to the jaw by a fulcrum in an arrangement whereby manual pressure applied to the lever element about the fulcrum causes flexing of the jaw.

This arrangement allows for the jaw to flex in such a way that the substance may be expressed from the tube effectively, by ensuring that pressure, when applied, is applied to the body of the tube without unduly constricting substance flow through the end of the tube proximal to its discharge outlet. It will be understood that the jaw itself may flex by deforming. This is distinct from prior arrangements where the opening and closing action of the jaws may be achieved by providing one or more of the jaws on a flexible leg. In such arrangements only the leg may flex but the jaw does not. This arrangement is also advantageous in that less material is used in its construction compared to prior art devices.

Preferably, the squeezer comprises a manual lever element on each jaw, each lever element being attached to a respective jaw by a fulcrum in an arrangement wherein manual pressure applied to the respective lever elements about each fulcrum causes flexing of the jaws. Flexing both jaws ensures that the substance in the deformable tube may be expressed effectively.

Suitably, the flexing of the or each jaw causes progressive opening of a mouth formed by the jaws. This ensures that expression of the substance is not prematurely constricted by the mouth of the jaw closing about the area of the tube proximal to the discharge outlet. It also allows for pressure to be applied progressively along the tube.

In one embodiment, the or each fulcrum is at a position proximate a mouth formed by the jaws. This arrangement is effective in avoiding the aforementioned premature constriction of substance expression.

In a further embodiment, the or each lever element flexes about the fulcrum when manual pressure is applied to the lever element. This allows the mouth formed by the jaws to be opened in the desired manner and with minimum manual pressure and a great degree of control. The progressive application of pressure can cause the degree of flexing to increase and in particular cause the point at which flexing occurs to vary depending on the amount of flexing arising due to variation in applied pressure.

In particular it is desirable that the manual lever element is not attached (and desirably is spaced apart) from the jaw to which it is attached save for through the fulcrum. Typically the fulcrum will be a fixed joint (non-hinged) and the relative movement, such as relative flexing of the lever element and the jaw is achieved by flexing of the jaw and possibly additionally the lever element.

It is desirable that the squeezer is formed as a unitary piece, for example constructed of a plastics material. The casing is desirably formed as a unitary piece, for example constructed of a plastics material. The entire device is thus easily constructed in two parts, for example by moulding.

In one embodiment the casing is open at its base end, the squeezer is insertable into the casing through its open base end, the jaws of the squeezer are attached at one end to a carrier, and the carrier and the casing have interengaging formations for retention of the squeezer in the casing.

This formation provides a very simple construction which is economical to manufacture and extremely simple to assemble. It allows for ease of insertion of the deformable tube into the device through the open base end, followed by insertion of the squeezer so that the jaws embrace the deformable tube.

In an embodiment, the device may additionally have an elongate nozzle which may be utilised to dispense material from the tube. The nozzle may be associated with the aperture in said top portion of said casing, said nozzle having a longitudinal axis, and comprising a base portion positioned proximal to said casing aperture with an intake end and an opposed shoulder portion, an upper portion extending axially from the shoulder portion to a distal dispensing end, the upper portion having a reduced cross section relative to the base portion, an internal conduit running from the intake end to the dispensing end, for delivering product from the intake end to the dispensing end, and engaging formations provided on the upper portion capable of inter-engaging with co-operating engaging formations on a cap to removably hold a cap in the closed position on the nozzle. This ensures that the substance expressed from the deformable tube may be applied accurately and effectively via the nozzle.

In a related embodiment, the device further comprises a cap for association with said nozzle, the cap having an elongate cap body with a longitudinal axis, an outside surface and an inside surface, the cap body comprising a first closed end longitudinally spaced from a second open end, the second end defining a mouth and connected to the inside surface, at least one sidewall integrally formed with and depending from the closed end to define a housing, the housing for receiving and overfitting at least a part of the nozzle upper portion; engaging formations provided on the inside surface capable of inter-engaging with co-operating engaging formations on said nozzle to removably hold the cap in the closed position on said nozzle; a plurality of elongate, angularly spaced apart wing portions, each wing portion having an inner part proximate the longitudinal axis of the cap, an outer part radially spaced therefrom, and two exterior opposing faces, each exterior face forming part of the outside surface of the cap, each exterior face contiguous with the next so that an exterior face of one wing portion together with an exterior face of an adjacent wing portion form one continuous surface between adjacent wing portions. This provides for an intuitive means of sealing the nozzle in such a way that it is clear when the cap is secure, thereby avoiding damage to the device and/or deformable tube due to torque applied in the over-tightening of the cap.

In another related embodiment, the cap and nozzle of the device further comprise additional, resilient interengaging portions that prevent the cap from being removed from the nozzle in the manner permitted by said engaging portions without the application of a desired level of force. This further minimises the risk of damage to the device and/or deformable tube due to torque applied in the over-tightening of the cap, as it may be more apparent to the user as to when the cap is on securely.

DETAILED DESCRIPTION OF THE DRAWINGS

One embodiment of the device of the invention will be described in more detail with reference to FIGS. 1 to 6.

Figure 1:
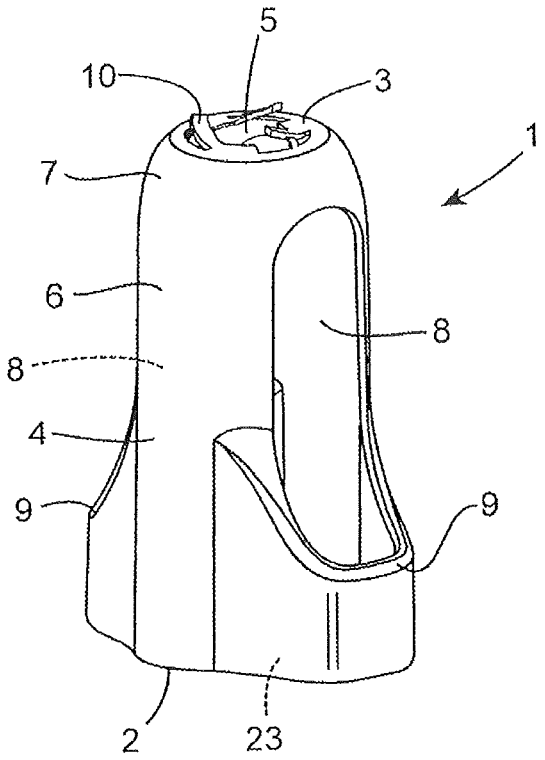
FIG. 1 shows a perspective view of a casing for the device of the invention.

FIG. 1 shows a hollow casing 1 having an open base end 2, a top portion 3 opposite the base end 2 and side wall portions 4 intermediate the base end and the top portion. The top portion 3 has an aperture 5 through which the discharge outlet 26 of a deformable tube 24 (see FIG. 5) is extendable. The casing 1 forms a sleeve-like or socket/receptor-type arrangement. The casing 1 has a central body portion 6 which is part cylindrical in shape and which extends from the base end 2 to the top portion 3 tapering inwardly close to the top portion 3 to provide a rounded head 7. Two slot-type apertures 8 are provided in opposing parts of the side wall portions 4. In its lower region, the casing is extended outwardly to form two shoulder portions 9 each respectively on opposing parts of the side wall portions 4 and part defining the apertures 8. The open base end 2 is defined by the central body portion 6, and the two shoulder portions 9 which are angular, so that the central portion 6 and each shoulder portion 9 define a key-hole type aperture so that the open end 2 has a double key-hole type shape. Ratchet members 10 are provided on the casing 1 at a periphery of the aperture 5 and are arranged for engaging a dispensing nozzle in the manner described below.

Figure 2:
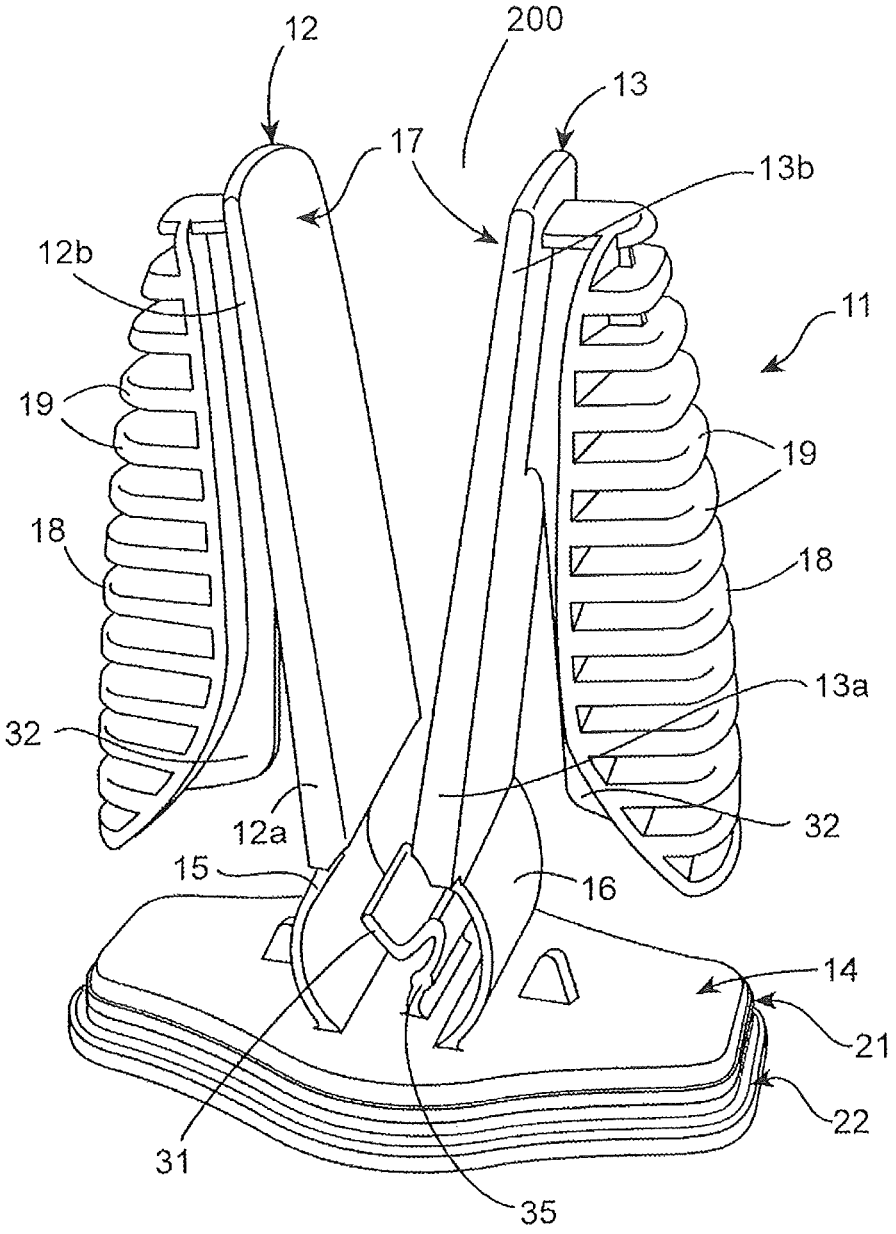
FIG. 2 is a perspective view of a squeezer and carrier which is insertable in the casing of FIG. 1.
Figure 3:
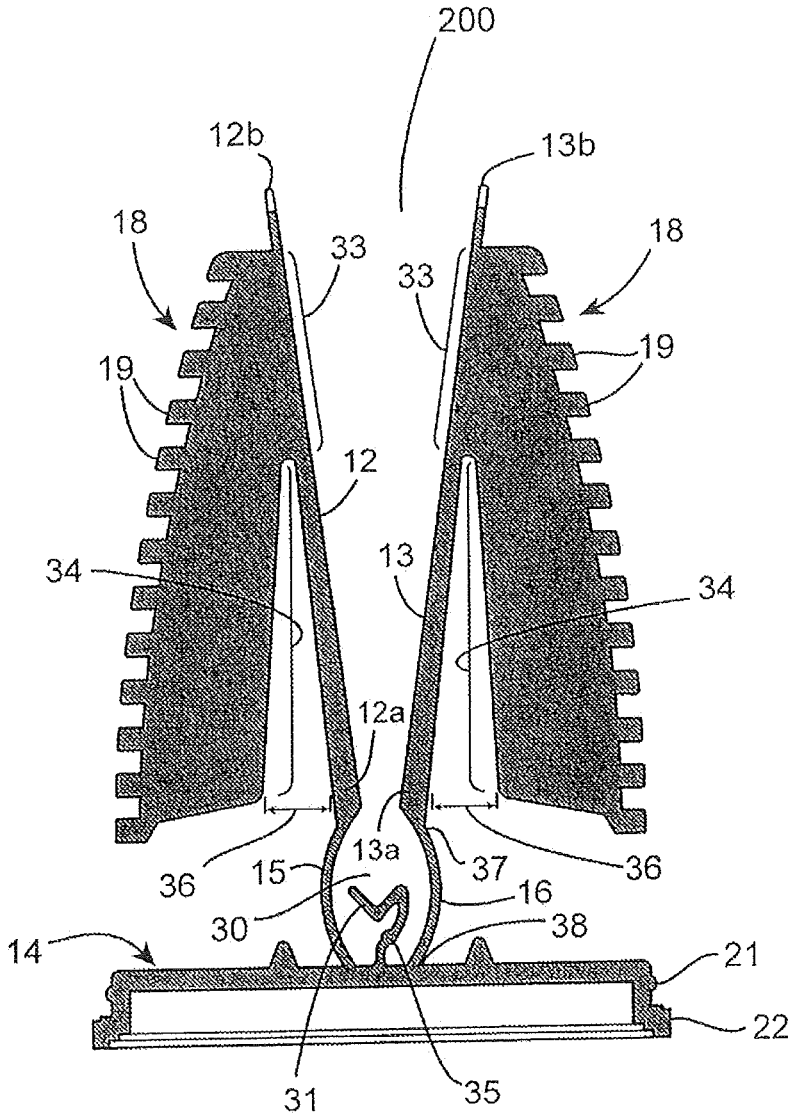
FIG. 3 is a cross-sectional side view of the squeezer of FIG. 2

FIGS. 2 and 3 show a squeezer 11 which is insertable in the casing 1. The squeezer has a first jaw 12 and an opposed second jaw 13, each of which has a supported end or proximal end 12*a*, 13*a* (proximate the carrier) connected to the carrier and a mouth or open end or distal end 12*b*,13*b* (distal the carrier) respectively, and which are held away from each other at the mouth 200 but are actuatable towards each other for gripping and expressing a substance from a deformable tube placed between the respective jaws 12, 13. Each jaw 12, 13 is attached at the supported end to a carrier 14 by resiliently deformable members formed by first and second jaw legs (curved) 15, 16 respectively. Between the point 38 at which each leg attaches the carrier 14 and the point 37 at which each leg attaches its corresponding jaw, the first and second jaw legs 15, 16 diverge from one another and then converge again such that they are in closer proximity to one another where they attach to their respective jaws and where they attach to the carrier then at any other point along their length. A support space 30 is thereby defined between the first and second jaw legs 15, 16. Situated within the support space 30, is a tube support 31, which forms a support for the base of the tube to hold it in alignment with the jaws. In the embodiment the tube support 31 is substantially V-shaped. The tube support 31 is attached to and elevated from the carrier 14 by a support leg 35 in order to ensure that when the base of a deformable tube rests on the support, the majority of the tube body is positioned between the jaws 12, 13. The jaws 12, 13 and the carrier 14 may be formed as one piece and thus moulded as a single piece for example from plastics. The first and second jaw legs 15, 16 are arranged on the carrier 14 so that the jaws 12, 13 diverge from the carrier to the free end of the jaws 12, 13, forming a general V-shape arrangement. The V-shape arrangement is particularly suited for receiving a deformable tube in particular a tube having a substantially flat closed end such as a tube of the shape of a crimped aluminium tube. Each jaw 12, 13 has a flat gripping or pressing surface 17 for pressing on the sides a deformable tube along the length of the sides of the tube. Each jaw 12, 13 has further fitted thereto a substantially rigid manual lever member 18 for actuating the jaws 12, 13. The manual lever 18 extends from a lever proximal end 20*a* adjacent the carrier 14 to a lever distal end 20*b*. The lever proximal end 20*a* is unconnected to the carrier 14. The manual lever member 18 includes a series of grippable ribs 19 which are attached to a spine 32. Each manual lever member 18 is fixedly attached to its corresponding jaw 12, 13 along a fulcrum joint 33 toward the open end of each jaw. Accordingly, there exists a free portion 34 of each lever member that is not directly attached to jaws 12, 13. The free portion 34 extends away from the fulcrum joint 33, back along the jaws and toward carrier 14. A lever space 36 is thereby defined between the free portion 34 of each lever member and its corresponding jaw. In the embodiment the lever space 36 narrows toward the fulcrum joint 33.

The carrier 14 is a plate, which has a profile corresponding in shape to the open end of the casing 1. The carrier 14 has a stepped surface formed by an upper rim 21 and a lower rim 22, the lower rim 22 projecting beyond the upper rim 21 about the perimeter of the carrier 14. The upper rim 21 forms a snap-fit rim, which snap-fits into an annular recess on the underside of the casing.

In the operating configuration of the device the squeezer 11 is inserted into the open base end 2 of the casing 1. The jaws 12, 13 pass inside the shoulder portions 9 and are then exposed through the slot-type apertures 8. The lever member 18 completes a smooth profile from the top portion 3 to the shoulder portions 9. The casing 1 acts as a socket-type arrangement so that when the squeezer 2 is inserted the upper rim 21 fits snugly into the aperture 23 (and engages therein) while the periphery of the base end 2 abuts the lower rim 22.

Figure 4A:
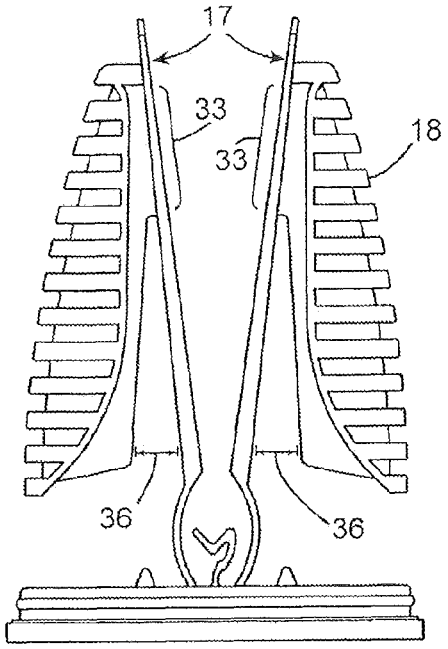
FIGS. 4*a-c* show a front view of the squeezer of FIGS. 2 & 3, flexing progressively.
Figure 4B:
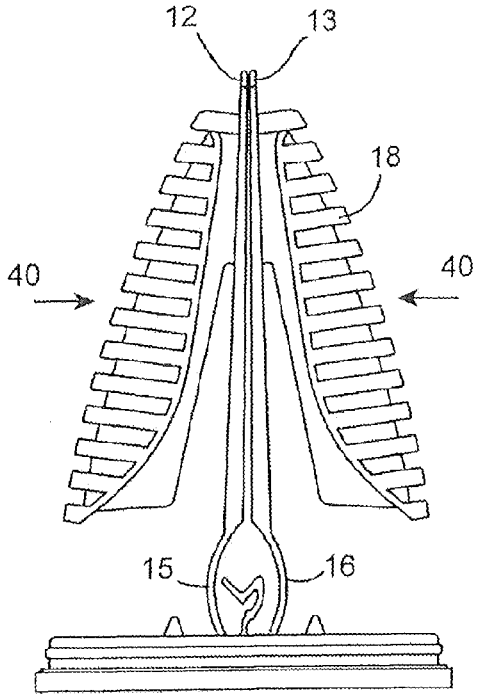

FIG. 4*a* shows a front view of the squeezer before pressure is applied to lever members 18. As pressure is initially applied to lever members 18 at a point which causes a turning moment about the fulcrum joint 33 and in the manner depicted by arrows 40 in FIG. 4*b*, force is transferred from lever members 18 via fulcrum joint 33 to jaws 12, 13. As this force is brought to bear on the jaws, legs 15, 16 flex so that the jaws 12, 13 converge until surfaces 17 abut the deformable tube positioned therebetween (the tube has been omitted in FIG. 4*a*-4C for convenience).

Figure 4C:
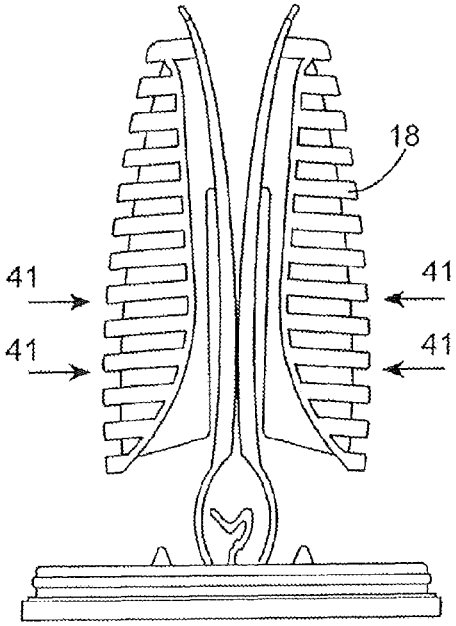

If further pressure is applied to free portions 34 of levers 18, as depicted in FIG. 4*c* by arrows 41, jaws 12, 13 do not converge further and application of further pressure 41 will result in flexing of each of the lever members 18 about the fulcrum joint 33 and causing a turning moment about the fulcrum and thus the progressive narrowing of spaces 36. This arises because of flexing of the jaws 12, 13. As the spaces 36 progressively narrow, the mouth defined by the jaws 12, 13 at their said open end begins to progressively open. A deformable tube is thus gripped between surfaces 17 and the applied pressure 41 as depicted in this figure ensures that while force is transferred to the tube in a manner so as to express the tube contents, flexing of the jaws 12, 13 takes place also by resilient deformation of the jaws such that the mouth defined by the jaws progressively opens. This ensures that expression of the substance in the tube is not hindered by constriction of the tube proximal to the mouth defined by the jaws. The point at which the jaws grip the tube can thus be varied because as the degree of pressure increases so too does the degree of flexing of the jaws. Pressure along the tube can thus be varied by a user allowing a greater degree of control.

Figure 5:
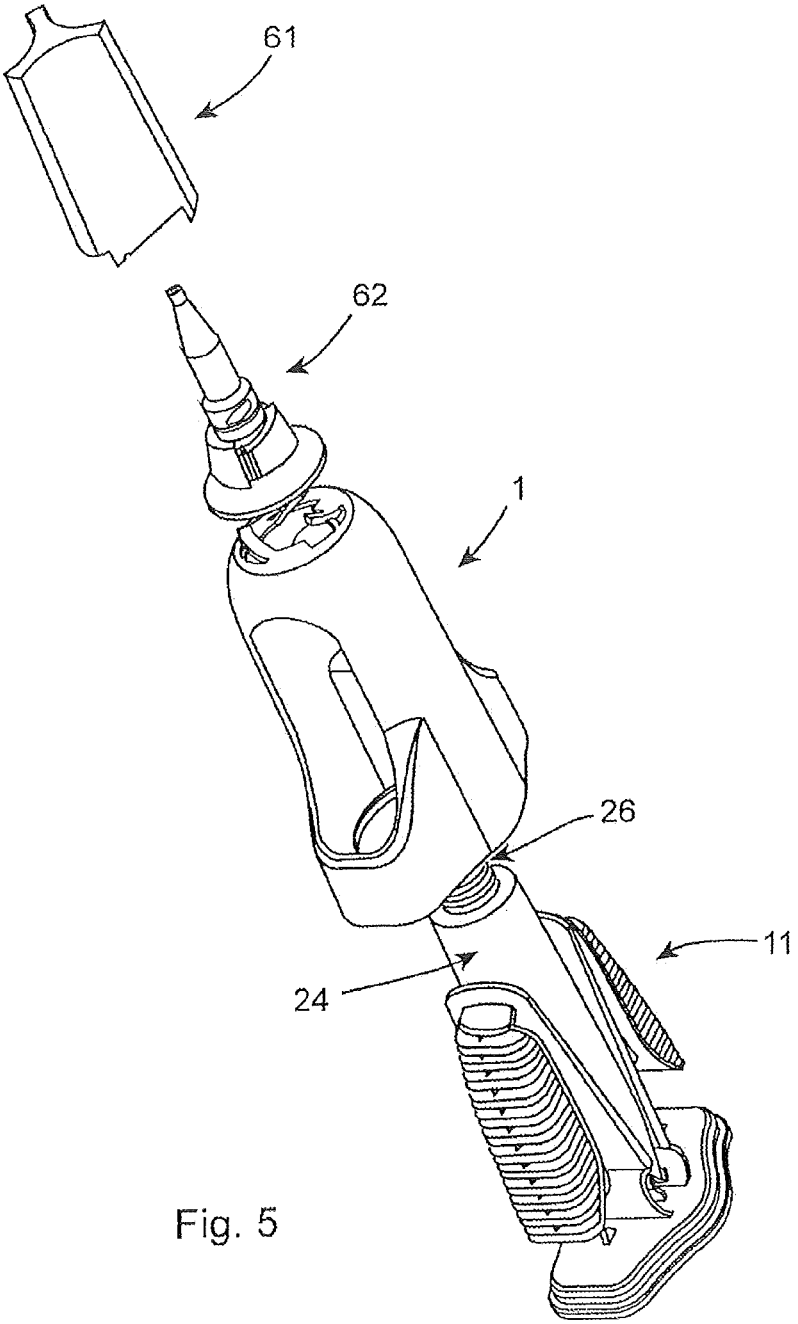
FIG. 5 shows an exploded view of a device of the invention as it would be assembled for operation including a squeezer, a deformable tube, a casing, a nozzle and a cap.

FIG. 5 shows an exploded view of an embodiment of the device as it would be assembled for use. The deformable tube 24 is placed between the jaws of the squeezer 11, and this assembly is inserted through the open base end 2 of the casing 1. The deformable tube has a discharge outlet 26 which is screw-threaded with outlet threads 28. In the assembled configuration the discharge outlet 26 extends through the top aperture 5 in the casing 1. A dispensing nozzle 62 with reciprocal screw-threads, nozzle threads 104 on its underside is adapted to screw onto the screw-threads, outlet threads 52 of discharge outlet nozzle 26 in the operational configuration where discharge outlet nozzle 26 extends through top aperture 5. A cap 61 is also provided.

Figure 6A:
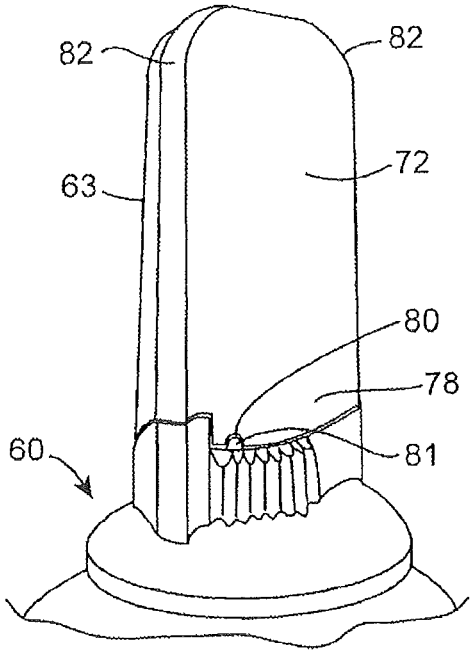
FIG. 6*a* shows the nozzle and cap assembly of FIG. 5 in their assembled configuration.
Figure 6B:
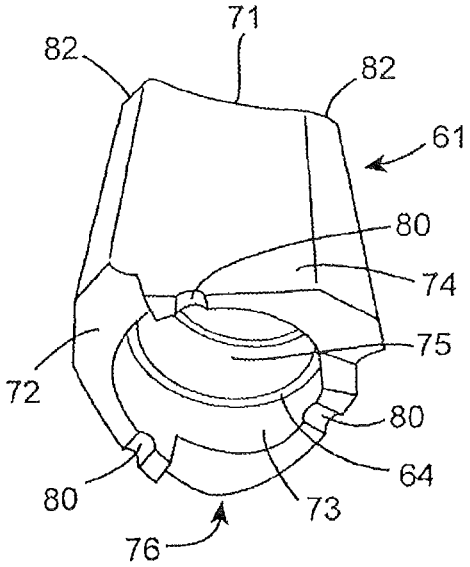
FIG. 6*b* shows a perspective view of the cap of FIG. 5 as viewed from beneath.
Figure 6C:
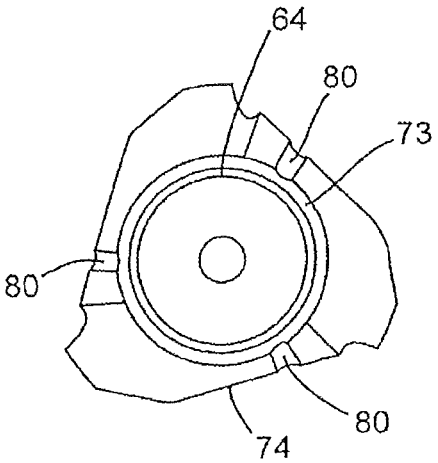
FIG. 6*c* shows a plan view of the cap of FIG. 5 as viewed from beneath.

FIGS. 6*a*-*d* depict a nozzle and cap assembly 60 for use in conjunction with the present invention and as depicted in FIG. 5. FIG. 6*b* shows a cap 61, which forms part of the cap/nozzle assembly 60. The cap 61 is for overfitting a nozzle 62 of the type depicted in FIG. 6*d*. The cap 61 has an elongate cap body 63, a first closed end 71 and an at least one side wall 72 which in the embodiment is a continuous side wall forming a continuous or endless wall, integrally formed with and depending from the closed end 71. The sidewall 72 is in the embodiment one wall that loops around to join with itself. It may be substantially circular but also other desired shapes. As shown best in FIG. 6*b*, the sidewall 72 has an inside surface 73 and an outside surface 74. The sidewall 72 forms a housing defined (bounded by) the inside surface 73 of the cap body 63. The sidewall 72 also forms an open end 76 at the base end 78 of the cap body 63 with a mouth defined by the continuous nature of the wall 72. The mouth 77 is effectively formed by the terminal face of the wall 72.

Figure 6D:
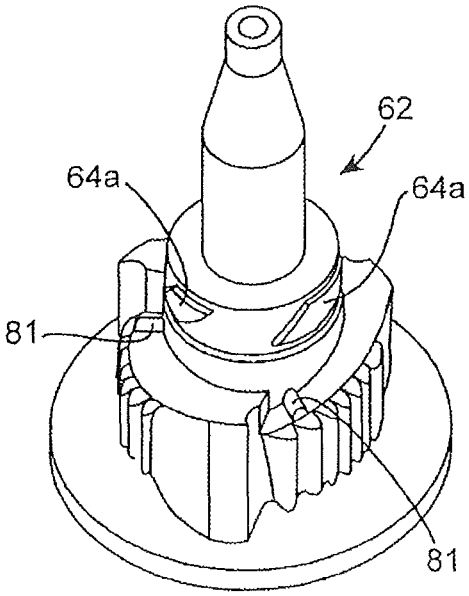
FIG. 6*d* shows a perspective view of the nozzle of FIG. 5.

The housing 75 is for receiving and overfitting at least a part of an elongate nozzle body of the nozzle 62 as shown in FIG. 6*d*. The nozzle 62 has a longitudinal axis, and a base portion 65 with an intake end 66 positioned proximal to the casing top aperture 5. The underside of the nozzle 62 has ratchet teeth 103, each having a ratchet tooth face 106, as depicted in FIGS. 7*b* and 7*c*. The nozzle 62 has a shoulder portion 68, and an upper portion 70 extending axially from the shoulder portion 68 to a distal dispensing end 69. The upper portion 70 has a reduced cross section relative to the base portion 65. An internal conduit 90 runs from the intake end 66 to the dispensing end 69, for delivering product from the intake end 66 to the dispensing end 69. Furthermore, engaging formations in the form of screw threads cap formations 64 are provided on the cap and are for inter-engaging with (reciprocal) co-operating engaging formations in the form of screw threads nozzle formations 64*a*, on the nozzle 62. The inter-engagement of the inter-engaging formations will, in the embodiment, removably hold the cap 63 in a position partially over-fitting the nozzle 62 as shown in FIG. 6*a*. At the base end 78 of the cap are a plurality of notches 80, which cooperate with a plurality of cooperating deformable protrusions 81 on the nozzle. When the cap is fitted the protrusions 81 are seated in the notches 80. When the cap is in place on the nozzle, as depicted in FIG. 6*a*, this notch/protrusion cooperation prevents unscrewing of the cap in the manner permitted by cap formations 64, unless sufficient force is applied. Accordingly, unintentional unscrewing of the cap may be often avoided.

With reference to FIG. 6*a*, the cap 61 has a plurality of elongate spaced apart wing portions 82. It is desirable that there are at least three wing portions, although more or less wing portions may be employed. Use of three wing portions provides the cap with a particularly ergonomic profile well suited to manipulation by a user's thumb, index and middle fingers. Desirably, each wing portion is equiangularly spaced apart from each adjacent wing portion.

Each wing portion 82 is contiguous with the adjacent ones and therefore the exterior shape (and profile) of the cap is defined entirely by the contiguous shape created by the wing portions. While it will be appreciated that different shapes of cap can be provided by employing different numbers and shapes of wing portions, the contiguous nature of the wing portions forming the cap should not be lost.

The wing portions 82 are given a part helical, a skewed or twisted appearance. The wing portions 82 are profiled in this way to give a visual indication to a user of the direction of twisting for removal of the cap.

In addition, the concave surfaces of the cap are helically skewed in the direction required to twist the cap to remove the cap from the nozzle. Normally, to remove a cylindrical cap from a cylindrical nozzle, a user will grip the cap with the thumb and fingers. With standard cylindrical or conical shaped caps, or even caps with lobes or ridges set perpendicular to the longitudinal axis of the cap, the user must exert forces in two directions simultaneously; the first force is a gripping force in the direction from the exterior of the cap towards the centre of the cap. The second force is a twisting, circular force, in the direction required to remove the cap from the nozzle. In circumstances where the cap is closed tightly on the nozzle, for example, by being additionally bonded by excess or spilled adhesive, the user must exert a very strong gripping force with fingers and thumb and exert the twisting force by means of additional arm and wrist motion. This can prove uncomfortable for the user, and can require a combination of strength and dexterity beyond some users.

The present invention overcomes or ameliorates to an extent these drawbacks by means of a cap for reversibly closing over a nozzle comprising at least three wing portions helically pitched in the direction required to remove the cap from the nozzle. Preferably, the cap comprises helically pitched (skewed) concave surfaces between the wing portions. The advantage of this is that when a user's thumb, index and middle fingers engage with the concave surfaces in a gripping action the helical pitch (twist) naturally biases the gripping force generated by the user in the direction required to remove (unscrew) the cap from the nozzle.

In addition, the helically pitched concave surfaces provides greater comfort than would non-concave surface when the user generates a twisting force to remove the cap from the nozzle with fingers and thumb.

Figure 7A:
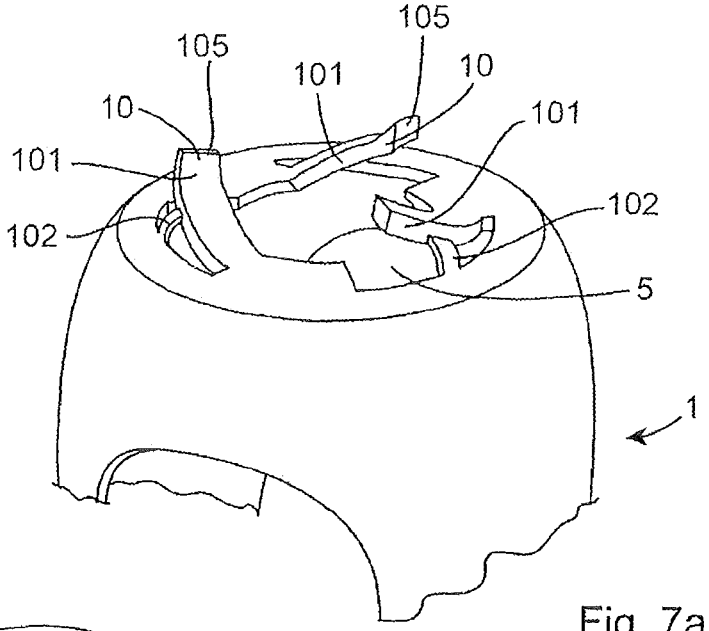
FIG. 7*a* shows a perspective view of the upper portion of the casing of FIG. 5
Figure 7B:
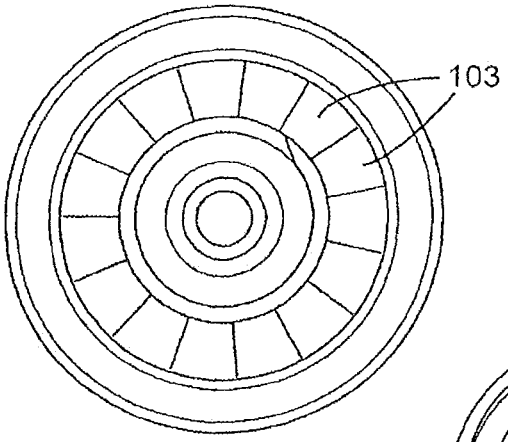
FIG. 7*b* shows a plan view of the nozzle of FIG. 5 as viewed from beneath.
Figure 7C:
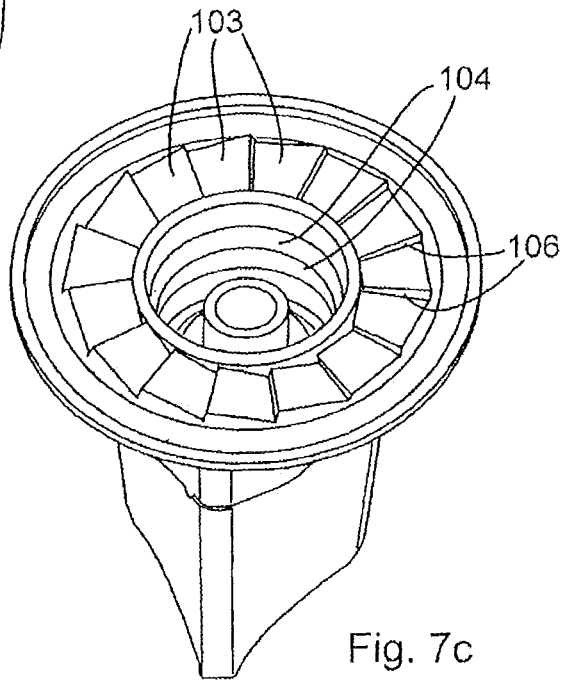
FIG. 7*c* shows a perspective view of the nozzle and cap assembly of FIG. 5 as viewed from beneath

FIG. 7*a* is a close-up perspective view of the top of the casing as shown in FIG. 5. As best seen in FIG. 7*a*, ratchet members 10 are provided on the periphery of the aperture 5 for engaging a dispensing nozzle in the manner described below. In this embodiment, each ratchet member 10 comprises a resilient arm 101 and a ratchet member face 105 which together form a pawl, and a supporting resilient strut 102. This arrangement is designed to cooperate with the underside of a nozzle 62 possessing ratchet teeth 103, each having a ratchet tooth face 106, as depicted in FIGS. 7*b* and 7*c*. When torque is applied to the nozzle in the direction consistent with the torque required to screw a cap onto the nozzle, the ratchet members 10 and ratchet teeth 103 resiliently deform and do not resist this force to any substantial extent. Rather, the ratchet teeth 103 slide over the ratchet members 10, depressing the resilient arms 101 as they go. The face 101 of each arm 101 does however then spring back to engage with respective teeth 103. Thus application of torque to the nozzle in the opposite direction, as would be done when unscrewing a cap from the nozzle, results in the locking of the nozzle in place. In this way, it is ensured that any attempt to unscrew the cap from the nozzle does not instead unscrew the cap and nozzle together from the deformable tube housed in the casing.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A device for expressing a substance from a deformable tube, the deformable tube having a discharge outlet with threads, the device comprising:

a squeezer having a carrier, the squeezer having a first jaw and an opposing second jaw, the first jaw extending from a jaw proximal end connected by a first jaw leg to the carrier to a first jaw distal end, the second jaw extending from a jaw proximal end connected by a second jaw leg to the carrier to a second jaw distal end, the connection of the first jaw leg to the carrier being independent of, and spaced from, the connection of the second jaw leg to the carrier, the first and second jaws diverging from one another from the proximal to the distal ends, the jaws being adapted for contacting the tube between the jaws and for expressing the substance from the tube, the squeezer having a manual lever on at least one jaw, the manual lever extending from a lever proximal end adjacent the carrier to a lever distal end, the lever proximal end being unconnected to the carrier, the manual lever distal end being attached to the jaw distal end, the squeezer having a fulcrum at the attachment of the manual lever distal end and the jaw distal end, the squeezer having a lever space between the jaw proximal end and the manual lever proximal end, the manual lever having a free portion adjacent the lever space, the free portion being unconnected to the jaw, the manual lever being adapted for manual grasping, wherein manual pressure applied to the manual lever about the fulcrum causes flexing of the jaw and narrowing of the lever space, so as to express the substance from the tube;

a hollow casing extending between a base end and a top portion, the casing having a side wall intermediate the base end and the top portion, the casing having a top aperture in the top portion, the top aperture being adapted to pass the tube discharge outlet therethrough, the top aperture having a periphery, the casing having at least one slot aperture through the side wall and extending from adjacent the base end to adjacent the top portion, the squeezer being adapted to be received in the casing, the slot aperture being adapted to receive the manual lever so as to allow manual actuation of the manual lever; and a nozzle having a longitudinal axis, the nozzle extending between a proximal intake end for attachment to the discharge outlet and a distal dispensing end for dispensing the substance, the nozzle having a base portion adjacent the intake end, the nozzle having an upper portion, the upper portion having a reduced cross section relative to the base portion, the nozzle having an internal conduit extending from the intake end to the dispensing end for delivering the substance from the intake end to the dispensing end, the nozzle being adapted for attachment to the casing top portion.

2. The device of claim 1, wherein the nozzle further comprises an underside, the nozzle having nozzle threads on the underside, the nozzle threads being adapted to screw onto the outlet threads of the discharge outlet.

3. The device of claim 1, further comprising a cap extending between a closed end and an open end, the cap having a sidewall, the sidewall having an inside surface and an outside surface, the cap being adapted for receiving the nozzle.

4. The device of claim 3, further comprising:

the nozzle having screw thread nozzle formations; and the cap having screw thread cap formations adapted for engaging the nozzle formations so as to removably hold the cap on the nozzle.

5. The device of claim 4, further comprising:

the nozzle having deformable protrusions; and the cap sidewall having notches at the open end, the notches being adapted for receiving the deformable protrusions so as to retain the cap on the nozzle.

6. The device of claim 3, wherein the cap further comprises a plurality of elongate helically pitched wing portions spaced apart; and concave surfaces between the wing portions, so as to establish gripping force to remove the cap from the nozzle.

7. The device of claim 2, further comprising:

the casing having at least one ratchet member extending upward on the periphery;

the nozzle having ratchet teeth on the underside adjacent the intake end, each ratchet tooth having a ratchet tooth face; and the ratchet member being adapted to resiliently engage the ratchet teeth so as to lock the nozzle in place and preclude unscrewing the nozzle from the deformable tube.

8. The device of claim 1, wherein the manual lever further comprises ribs extending outward from the manual lever for gripping.

9. The device of claim 1, wherein the squeezer further comprises a generally V-shaped tube support disposed between the first and second jaw legs for supporting the tube.

10. The device of claim 1, wherein the manual lever further comprises ribs extending outward from the manual lever for gripping.

11. The device of claim 1, further comprising a tube support disposed between, but not connected to, the first jaw leg and the second jaw leg, the tube support projecting above the carrier.

12. The device of claim 1, further comprising a tube support leg disposed between, but not connected to, the first jaw leg and the second jaw leg, the tube support leg having a proximal end connected to the carrier and a distal end projecting above the carrier; and a tube support connected to the tube support leg proximal end.

13. The device of claim 1, wherein the first jaw leg is curved and the second jaw leg is curved.

14. The device of claim 1, wherein a first force applied to the lever moves the distal ends of the first and second jaws toward each other and a second force greater than the first force applied to the lever moves the distal ends of the first and second jaws away from each other.

15. A device for expressing a substance from a deformable tube, the deformable tube having a discharge outlet, the device comprising:

a squeezer including a carrier, a first jaw and an opposing second jaw, the first jaw extending from a first jaw proximal end to a first jaw distal end, the first jaw proximal end connected by a first jaw leg to the carrier, the second jaw extending from a second jaw proximal end to a second jaw distal end, the second jaw proximal end connected by a second jaw leg to the carrier, the connection of the first jaw leg to the carrier being independent of, and spaced from, the connection of the second jaw leg to the carrier, a first lever on the first jaw, the first lever extending from a first lever proximal end adjacent the carrier to a first lever distal end, the first lever distal end being attached to the first jaw distal end, the first lever proximal end being unconnected to the carrier, the first lever proximal end being unconnected to the first jaw proximal end to define a space between the first lever proximal end and the first jaw proximal end, the attachment of the first lever distal end and the first jaw distal end defining a first fulcrum, a tube support leg disposed between, but not connected to, the first jaw leg and the second jaw leg, the leg having a proximal end attached to the carrier and a distal end projecting from the carrier, a tube support attached to the tube support leg distal end, the tube support disposed between the carrier and the jaw proximal ends;

a hollow casing disposed over the squeezer, the casing extending between a base end and a top portion, the casing having a side wall intermediate the base end and the top portion, the casing having a top aperture in the top portion, the tube discharge outlet passing through the top aperture, the top aperture having a periphery, the casing having at least one slot aperture through the side wall and extending from adjacent the base end to adjacent the top portion, the casing having at least one shoulder portion extending outward from the side wall on either side of the slot aperture, the first lever disposed within the slot aperture to allow manual actuation of the first lever by a user.

16. The device of claim 15, further comprising a second lever on second first jaw, the second lever extending from a second lever proximal end adjacent the carrier to a second lever distal end, the second lever distal end being attached to the second jaw distal end, the second lever proximal end being unconnected to the carrier, the second lever proximal end being unconnected to the second jaw proximal end to define a space between the second lever proximal end and the second jaw proximal end, the attachment of the second lever distal end and the second jaw distal end defining a second fulcrum; and a second slot aperture through the side wall and extending from adjacent the base end to adjacent the top portion;

the second lever is disposed within the second slot aperture to allow manual actuation of the second lever by a user.

17. The device of claim 15, further comprising a second lever on second first jaw, the second lever extending from a second lever proximal end adjacent the carrier to a second lever distal end, the second lever distal end being attached to the second jaw distal end, the second lever proximal end being unconnected to the carrier, the second lever proximal end being unconnected to the second jaw proximal end to define a space between the second lever proximal end and the second jaw proximal end, the attachment of the second lever distal end and the second jaw distal end defining a second fulcrum; and a second slot aperture through the side wall and extending from adjacent the base end to adjacent the top portion, wherein the second slot aperture and the first slot aperture are axially symmetrically disposed in the casing;

the second lever is disposed within the second slot aperture to allow manual actuation of the second lever by a user, wherein the second lever and the first lever are axially symmetrically disposed in the casing.

* * * * *